US007296717B2

(12) United States Patent
Swanson et al.

(10) Patent No.: US 7,296,717 B2
(45) Date of Patent: Nov. 20, 2007

(54) METHOD AND APPARATUS FOR CONTROLLING A MOVING WEB

(75) Inventors: Ronald P. Swanson, Woodbury, MN (US); James N. Dobbs, Woodbury, MN (US); Daniel H. Carlson, Arden Hills, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 78 days.

(21) Appl. No.: 10/719,557

(22) Filed: Nov. 21, 2003

(65) Prior Publication Data

US 2005/0109811 A1 May 26, 2005

(51) Int. Cl.
*B65H 23/02* (2006.01)

(52) U.S. Cl. ..... 226/3; 226/21; 226/115; 226/117; 242/615.1; 242/615.2

(58) Field of Classification Search ..... 242/615.1, 242/615.2; 226/44, 45, 115, 117, 3, 21
See application file for complete search history.

(56) References Cited

U.S. PATENT DOCUMENTS

| | | | | |
|---|---|---|---|---|
| 1,634,984 | A | 7/1927 | Dickhaut | |
| 2,797,091 | A | 6/1957 | Fife | |
| 2,821,387 | A | 1/1958 | Faeber | |
| 2,989,265 | A * | 6/1961 | Selsted | 226/196.1 |
| 3,343,737 | A * | 9/1967 | Alexeff et al. | 226/21 |
| 3,373,288 | A | 3/1968 | Otepka et al. | |
| 3,411,683 | A | 11/1968 | Bartles et al. | |
| 3,599,849 | A | 8/1971 | Callan | |
| 3,615,048 | A | 10/1971 | Martin | |
| 3,682,362 | A | 8/1972 | Ott, Jr. | |
| 3,942,696 | A | 3/1976 | Pira et al. | |
| 3,966,105 | A | 6/1976 | Curran | |
| 4,069,959 | A | 1/1978 | Bartell et al. | |
| 4,200,211 | A | 4/1980 | Yamagishi et al. | |
| 4,204,619 | A | 5/1980 | Damour | |
| 4,212,419 | A | 7/1980 | Huber | |
| 4,212,422 | A | 7/1980 | Rauchfuss, Jr. et al. | |
| 4,214,689 | A | 7/1980 | Bartel et al. | |

(Continued)

OTHER PUBLICATIONS

Article: Williams, "Ten Web Guiding Truisms," Fife Corporation, P.O. Box 26508, Oklahoma City, OK 73126-0508, date unknown but prior to filing date of instant application, 12 pages.

(Continued)

*Primary Examiner*—Peter M. Cuomo
*Assistant Examiner*—Sang Kim
(74) *Attorney, Agent, or Firm*—Rick L. Franzen

(57) ABSTRACT

A method of controlling a moving web in relation to a selected transverse position comprising positioning a first positioning guide proximate a second positioning guide wherein the second positioning guide has a mechanism for positioning the web having minimal backlash. The web is passed through the first positioning guide and the second positioning guide. A sensor detects the transverse position of the moving web at the second positioning guide. The sensor transmits the transverse location of the web at the second positioning guide to a controller. The controller manipulates a zero-backlash actuator wherein the zero-backlash actuator is coupled to the second positioning guide such that the transverse position of the web is controllable to within a preselected dimension of the selected transverse position.

35 Claims, 5 Drawing Sheets

U.S. PATENT DOCUMENTS

| | | | | |
|---|---|---|---|---|
| 4,243,167 | A | 1/1981 | Sander | |
| 4,316,568 | A | 2/1982 | Grant et al. | |
| 4,322,026 | A | 3/1982 | Young, Jr. | |
| 4,336,900 | A | 6/1982 | Pontoni | |
| 4,342,412 | A | 8/1982 | Lorenz et al. | |
| 4,403,533 | A | 9/1983 | Cox et al. | |
| 4,477,006 | A | 10/1984 | Sharp | |
| 4,572,417 | A | 2/1986 | Joseph et al. | |
| 4,573,619 | A | 3/1986 | Grant | |
| 4,598,849 | A | 7/1986 | Frye et al. | |
| 4,609,012 | A | 9/1986 | Shelton | |
| 4,901,903 | A | 2/1990 | Blanding | |
| 4,961,089 | A | 10/1990 | Jamzadeh | |
| 4,964,557 | A | 10/1990 | Sarkisian et al. | |
| 4,991,787 | A | 2/1991 | Berg | |
| 5,059,286 | A | 10/1991 | Beisswanger et al. | |
| 5,072,414 | A | 12/1991 | Buisker et al. | |
| 5,111,986 | A | 5/1992 | Niemann | |
| 5,119,981 | A | 6/1992 | Gnuechtel et al. | |
| 5,226,577 | A | 7/1993 | Kohler | |
| 5,274,573 | A | 12/1993 | Buisker et al. | |
| 5,360,152 | A | 11/1994 | Matoushek | |
| 5,558,263 | A | 9/1996 | Long | |
| 5,664,738 | A | 9/1997 | Fife | |
| 5,711,470 | A | 1/1998 | Thompson | |
| 5,769,298 | A | 6/1998 | Plumb | |
| 5,834,877 | A | 11/1998 | Buisker et al. | |
| 6,047,873 | A * | 4/2000 | Carlberg et al. | 226/97.1 |
| 6,192,955 | B1 | 2/2001 | Rice | |
| 6,214,147 | B1 * | 4/2001 | Mortellite et al. | 156/201 |
| 6,323,948 | B2 | 11/2001 | Haque et al. | |
| 6,354,478 | B1 | 3/2002 | Brückel | |
| 6,766,934 | B2 * | 7/2004 | Ziegelaar et al. | 226/21 |

OTHER PUBLICATIONS

Seminar: Shelton, Web Handling Research Center a National Science Foundation University/Industry Cooperative Research Center, WHRC Semiannual Meeting, Apr. 1988, 13 pages.

Conference: Good et al., "Wrinkling of Webs Due to Twist," Fifth International Conference on Web Handling, Jun. 6-9, 1999, 15 pages.

Project Report: Shelton, Lateral Control of a Web (9700-1), WHRC Project Report, Nov. 1997, pp. 14-1to 14-38.

Project Report: Shelton, Lateral Control of a Web (9700-1), WHRC Project Report, Jun. 1998, pp. 13-1 to 13-28.

Project Report: Shelton, Lateral Control of a Web (9700-1), WHRC Project Report, Oct. 1998, pp. 12-1 to 51.

Project Report: Shelton, Lateral Control of a Web (9700-1), WHRC Project Report, Oct. 1999, pp. 12-1 to 12-27.

Project Report: Shelton et al., Lateral Control of a Web (9700-1), WHRC Project Report, Jun. 2000, pp. 12-1 to 12-59.

Project Report: Shelton, Lateral Contrl of a Web (9700-1), WHRC Project Report, Oct. 2000, pp. 9-1 to 9-8.

Project Report: Shelton, Lateral Control of a Web (9700-1), WHRC Project Report, Jun. 2001, pp. 8-1 to 8-43.

Project Report: Shelton, Lateral Control of a Web (9700-1), WHRC Project Report, Oct. 2001, pp. 3-1 to 3-28.

Project Report: Shelton, Lateral Control of a Web (9700-1), WHRC Project Report, Jun. 2002, pp. 7-1 to 7-47.

Project Report: Shelton, Lateral Control of a Web (9700-1), WHRC Project Report, Oct. 2002, pp. 6-1 to 6-55.

Project Report: Shelton, Lateral Control of a Web (9700-1), WHRC Project Report, Jun. 2003, pp. 5-1 to 5-43.

Project Report: Shelton, Lateral Control of a Web (9700-1), WHRC Project Report, Jun. 2004, pp. 5-1 to 5-90.

Book: Good, "Proceedings of the Sixth International Conference on Web Handling," Web Handling Research Center, Oklahoma State University, Stillwater, Oklahoma, Jun. 10-13, 2001, Title pages and Table of Contents.

Conference: Shelton, "Installation and Performance of Classical Web Guides," Seventh International Conference on Web Handling, Oklahoma State University, Stillwater, Oklahoma, Jun. 1-4, 2003, 22 pages.

* cited by examiner

METHOD AND APPARATUS FOR CONTROLLING A MOVING WEB

BACKGROUND OF THE INVENTION

The present invention generally relates to a method and an apparatus for controlling a moving web. More specifically, the present invention relates to a web guide apparatus having minimal mechanical backlash cooperating with a high speed control system which allows for precise control of a transverse location of the moving web. The present invention further includes a method of controlling the transverse location of the web.

Generally, there are two types of guide systems for controlling a transverse position of a moving web. A first type of guide system for controlling a transverse position of a moving web is a passive system.

An example of a passive system is a crowned roller, also called a convex roller, having a greater radius in the center than at the edges. Crowned rollers are effective at controlling webs that are relatively thick in relation to the width of the web such as sanding belts and conveyor belts.

Another passive type of guide system is a tapered roller with a flange. The taper on the roller directs the web towards the flange. The web edge contacts the flange and thereby controls the transverse position of the web. A tapered roller with a flange is commonly used to control the lateral position of a narrow web, such as a videotape.

However, a passive guide system cannot guide wide, thin webs because, depending on the type of passive guide system, either the edge of the web tends to buckle or the web tends to develop wrinkles. To effectively control a wide, thin web an active guide system is required.

A typical active guide system includes a sensing device for locating the position of the web, a mechanical positioning device, a control system for determining an error from a desired transverse location and an actuator that receives a signal from the control system and manipulates the mechanical positioning device. A typical control system used for actively guiding a thin, wide web is a closed loop feedback control system.

Typically, a web to be processed has been previously wound onto a spool. During the winding process, the web is not perfectly wound and typically has transverse positioning errors in the form of a zigzag or a weave. When the web is unwound, the zigzag or weave errors recur causing transverse web positioning problems.

In precision web applications such as webs used in optics and electronics, the transverse location of the web must be precisely controlled. Most commercially available active web guide systems are not capable of controlling the transverse location to the level of precision required for these web applications. Commercial web guides typically employ rod ends, belts, sheaves, slides and threaded nuts and bolts, each of which has some mechanical play. Often, in a commercially available guide, the total mechanical play is in range of 125-375 microns (0.005-0.015 inches). A control system cannot guide a web to within a range of the guide's backlash or mechanical play.

While the control system of a commercially available web guide has some error, often the error caused by the control system is insignificant when compared to the error caused by the mechanical backlash or play in the guide. The mechanical backlash, without accounting for any other error can preclude many commercially available web guides from being used for precisely locating a transverse location of a moving web.

BRIEF SUMMARY OF THE INVENTION

The present invention includes a method of controlling a moving web in relation to a selected transverse position comprising positioning a first positioning guide proximate a second positioning guide wherein the second positioning guide includes a mechanism for positioning the web having minimal backlash. The web is passed through the first positioning guide and the second positioning guide. A sensor detects the transverse position of the moving web at the second positioning guide. The sensor transmits the transverse location of the web at the second positioning guide to a controller. The controller manipulates a zero-backlash actuator where the zero-backlash actuator is coupled to the second positioning guide such that the transverse position of the web is controllable to within a preselected dimension of the selected transverse position.

DETAILED DESCRIPTION

Figure 1:
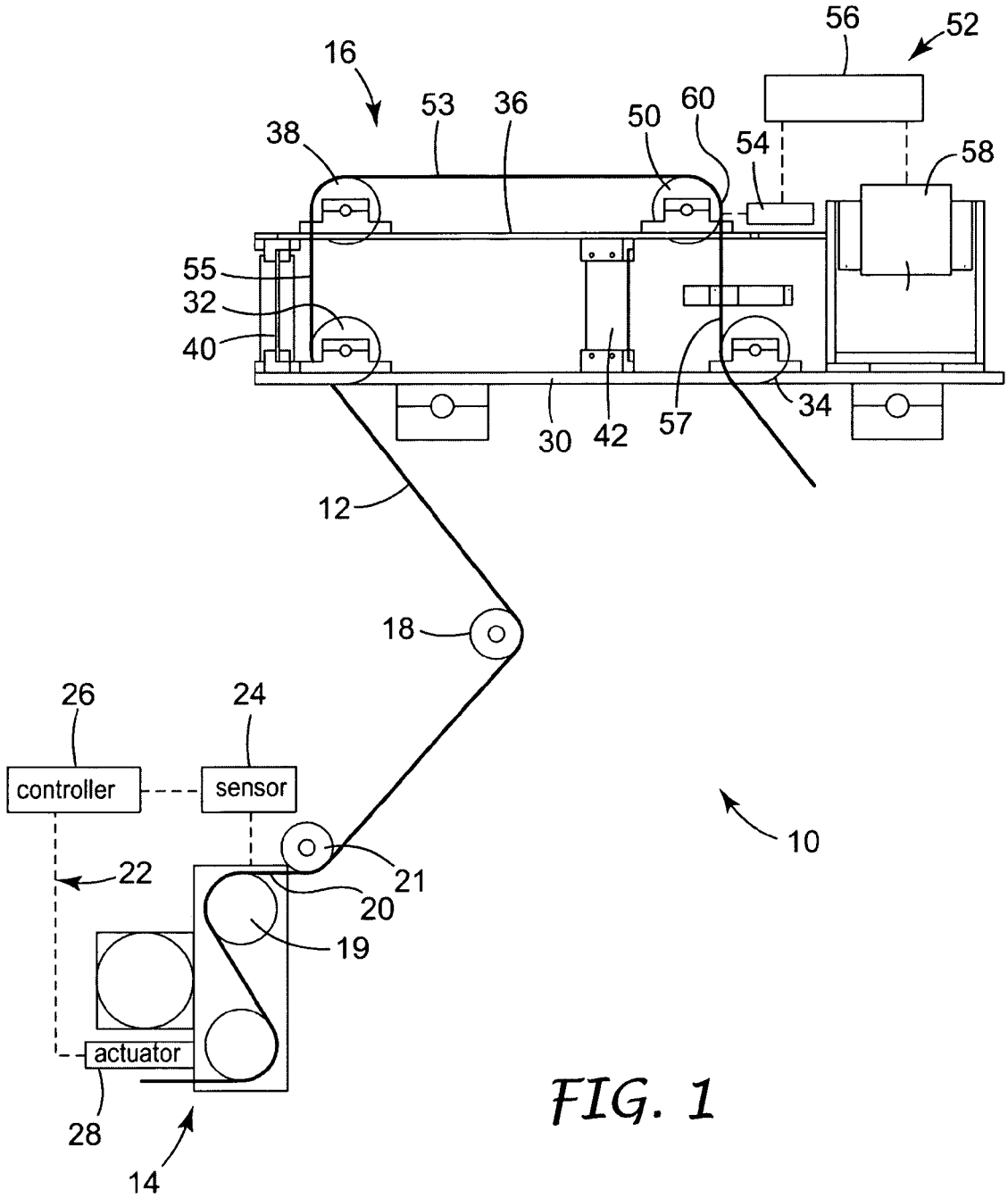
FIG. 1 is a schematic view of the precision web guide assembly of the present invention.

The present invention generally relates to an assembly for controlling a transverse location of a moving web. The assembly includes a first web guide in series with a second web guide. The first web guide is manipulated by a first control system and the second web guide is manipulated by a second control system. The first and second control systems control the first and second web guides independent of each other to provide precision control of the transverse position of the moving web.

The assembly provides precise control of the transverse position of the moving web because of a number of design features including, but not limited to, positioning the first web guide, having a short exit span, and upstream and proximate the second web guide. The first web guide reduces the input angle error, the transverse position error, and the error rate of the moving web entering the second web guide.

With the input angle error, the transverse position error, and the error rate reduced by the first web guide, the second web guide precisely controls the transverse position of the moving web. The second web guide is designed to be lightweight and stiff while minimizing backlash caused by mechanical play. The lightweight, stiff second web guide with minimal backlash allows the second control system, having a fast, high resolution sensor communicating with a fast control system, to precisely control the transverse location of the moving web with a high bandwidth, zero backlash actuator connected to the second web guide with a zero backlash connection.

The second web guide also includes a relatively long guide span and a relatively short exit span. The long guide span reduces an angle needed to produce a correction to the transverse position of the moving web and reduces a twist angle of the moving web in the entrance and exit spans. The short exit span reduces the transverse position error caused by the input angle error.

As used herein, the terms "precision control" or "precise control" means controlling a transverse position of the web to within less than about 0.004 inches (0.0102 mm) of a desired location.

As used herein, the term "backlash" corresponds to the amount of mechanical play or lost motion found in the web guide. Backlash adversely affects the ability of a control system to precisely control the transverse position of the moving web.

As used herein, the term "zero-backlash" means tolerances or mechanical play of less than about 0.0001 inch (0.0025 mm).

As used herein, the term "exit span" means the distance between the last frame roller and the second base roller of the web guide that is preferably expressed in terms of a factor of a width of the web.

As used herein, the term "entrance span" means the distance between the first base roller and the first frame roller of the web guide that is preferably expressed in terms of a factor of a width of the web.

As used herein, the term "guide span" means the distance between the entrance span and the exit span. The guide span is preferably expressed in terms of a factor of a width of the web.

As used herein, the term "input angle error" is the error in the angular position of the web from the desired angle of the web as the web is detected by the sensor. Typically, the input angle error of the moving web is undetectable by a single web position sensor. Since a web position sensor detects the position of the web at only one point, the sensor detects the position of the web, but not the input angle of the web. Therefore, a single sensor may detect no positional error while there may be a significant amount of input angle error that is undetected. The input angle error, although undetected by a single position sensor, may result in a significant downstream position error.

The present invention generally includes an assembly 10 and method for precisely controlling a transverse position of a moving web 12 as illustrated in FIG. 1. The moving web 12 is passed through a first web guide 14 followed by a second web guide 16. While an exact distance between the first web guide 14 and second web guide 16 is not critical to practice the invention, it is preferred that first web guide 14 and second web guide 16 be disposed in close proximity with minimal or no intermediate processing of the web 12. In an exemplary embodiment, an idler roller 18 is disposed within the path of the moving web 12 between the first web guide 14 and the second web guide 16.

The first web guide 14 can include any conventional commercially available web guide. It is preferred that an exit span 20 between the last roller 21 and the second to the last roller 19 of the first web guide 14 be relatively short compared to an exit span of a conventional web guide. A short exit span 20 on the first web guide 14 significantly reduces the transverse angular error of the moving web 12, reduces the input angle error, and minimizes output error. The exit span 20 of the first web guide 14 is preferably less than about one-half of the width of the moving web 12. Upon reading this specification, one skilled in the art will appreciate that the shortest exit span possible is preferred that does not result in the wrinkling of the moving web 12. An exemplary commercially available web guide that can be used as the first web guide is a DF Rotating Frame Guide "P-Model" manufactured by BST Pro Mark of Elmhurst, Ill.

Preferably, the first web guide 14 includes a first control system 22 that independently controls the first web guide 14. The first control system 22 is preferably a closed loop feed back system, although a feed forward system, H infinity system, model based system, embedded model based system or any other control system which will effectively control the transverse position of the moving web 12 is also within the scope of the invention.

The first control system 22 includes a first web position sensor 24 that preferably detects a position of an edge of the moving web 12. One skilled in the art will recognize that other position detecting sensors besides edge position sensors are within the scope of the invention. The first web position sensor 24 communicates with a first controller 26. The first controller 26 detects the error of the transverse position of the edge of the moving web 12 from a selected setpoint. The first controller 26 preferably employs a proportional-integral controller (PI) control scheme.

The first controller 26 communicates the error to an actuator 28. The actuator 28 adjusts the position of the first web guide 14 depending on the magnitude of error calculated by the first controller 26.

Referring to FIG. 1, after the moving web 12 exits the first web guide 14, the moving web 12 preferably passes over the idler roller 18 prior to entering into the second web guide 16. After passing through the first web guide 14, the input error rate, the input angle error and the output transverse error of the moving web 12 have been significantly reduced as the moving web 12 enters the second web guide 16. The second web guide 16, as illustrated in FIGS. 2-5, is also referred to as a precision web guide. The precision web guide 16 manipulates the transverse position of the moving web 12 to within less than about 0.004 inches (0.102 mm) of a desired transverse location.

The moving web 12 passes over a first base roller 32 disposed within a base 30 of the precision web guide 16. The base 30 is fixed in a selected position, preferably with a plurality of bolts, however the base may be fixed into the selected position by a weld, a plurality of rivets or any other fastening means which fixedly retains the base in the selected position.

The base 30 also includes a second base roller 34 disposed therein. Preferably, an axis 35 of the first base roller 32 is substantially parallel to an axis 37 of the second base roller 34. Both the first and second base rollers 32, 34, respectively, include laterally loaded or precision bearings. The laterally loaded or precision bearings are preferred to minimize or eliminate lateral backlash within the first and second base rollers 32, 34 respectively. An exemplary laterally loaded bearing can be purchased along with an Ultralight Aluminum Idler manufactured by Webex, Inc. of Neenah, Wis.

After passing over the first base roller 32, the moving web 12 contacts and passes over a first frame roller 38 that is disposed within a frame 36. The frame 36 is connected to the base 30 but is also movable with respect to the base 30. Preferably, the frame 36 is connected to the base 30 with a plurality of flexure plates 40, 42, 44, 46 as viewed in FIGS. 1-5. The plurality of flexure plates 40, 42, 44, 46 allows the frame 36 to move relative to the base 30 without any mechanical backlash or mechanical play. Although a plurality of flexure plates 40, 42, 44, 46 is preferred, one skilled in the art will recognize that other connecting mechanisms which allow the frame to move relative to the base with minimal or no mechanical backlash are within the scope of the invention. The alternative connecting mechanisms include, but are not limited to, linear ways, a precision pivot, and preloaded mechanical components.

Referring to FIGS. 2-5, a length of each flexure plate 40, 42, 44, 46 is significantly longer when compared to a width of each flexure plate 40, 42, 44, 46. The flexure plates 40, 42, 44, 46 are designed to flex along the width of the flexure plate while maintaining stiffness along the length of the plate. In the exemplary embodiment, the frame is connected to the base with four flexure plates 40, 42, 44, 46.

Figure 2:
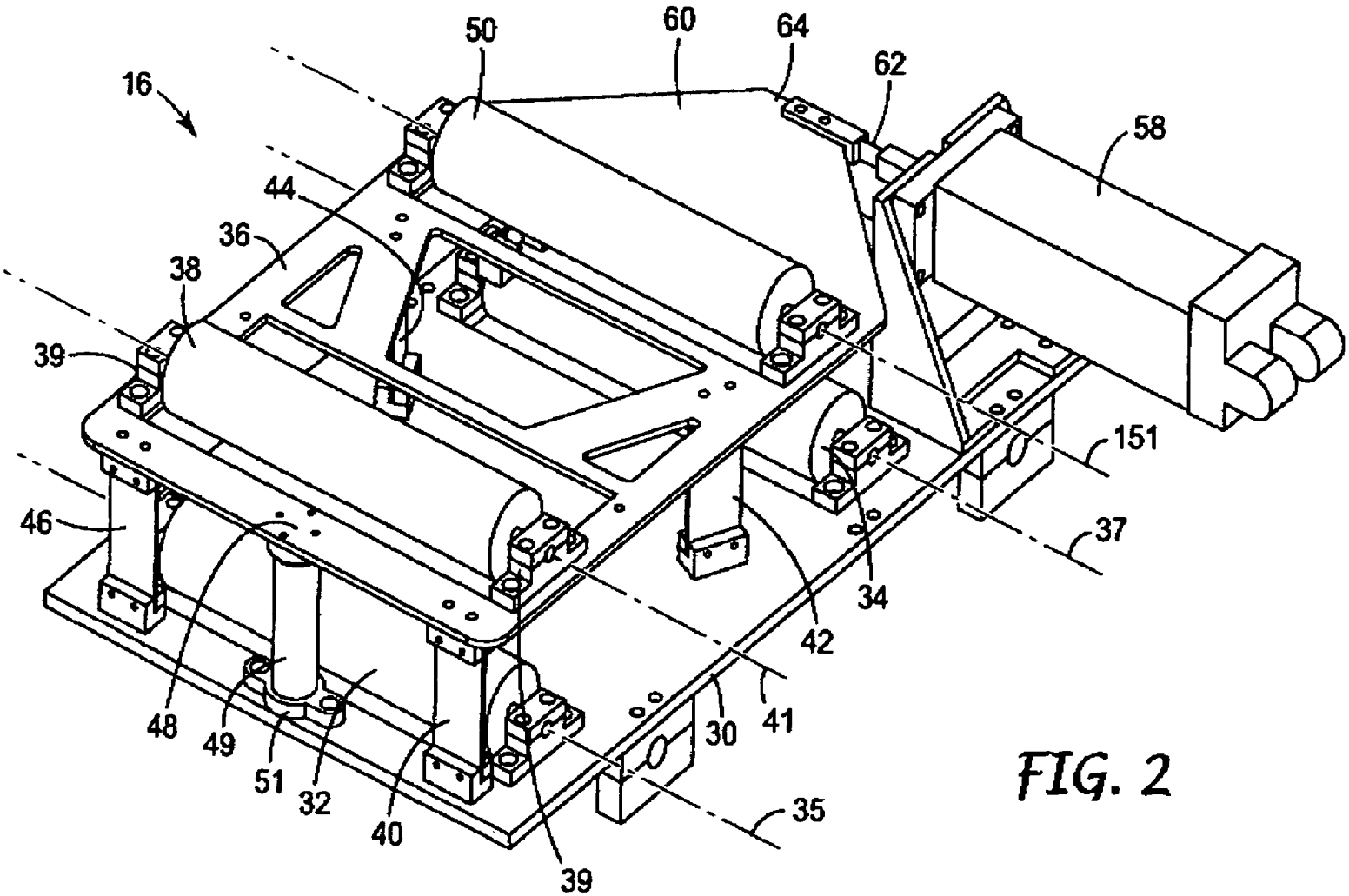
FIG. 2 is a perspective view of a precision web guide of the present invention.
Figure 3:
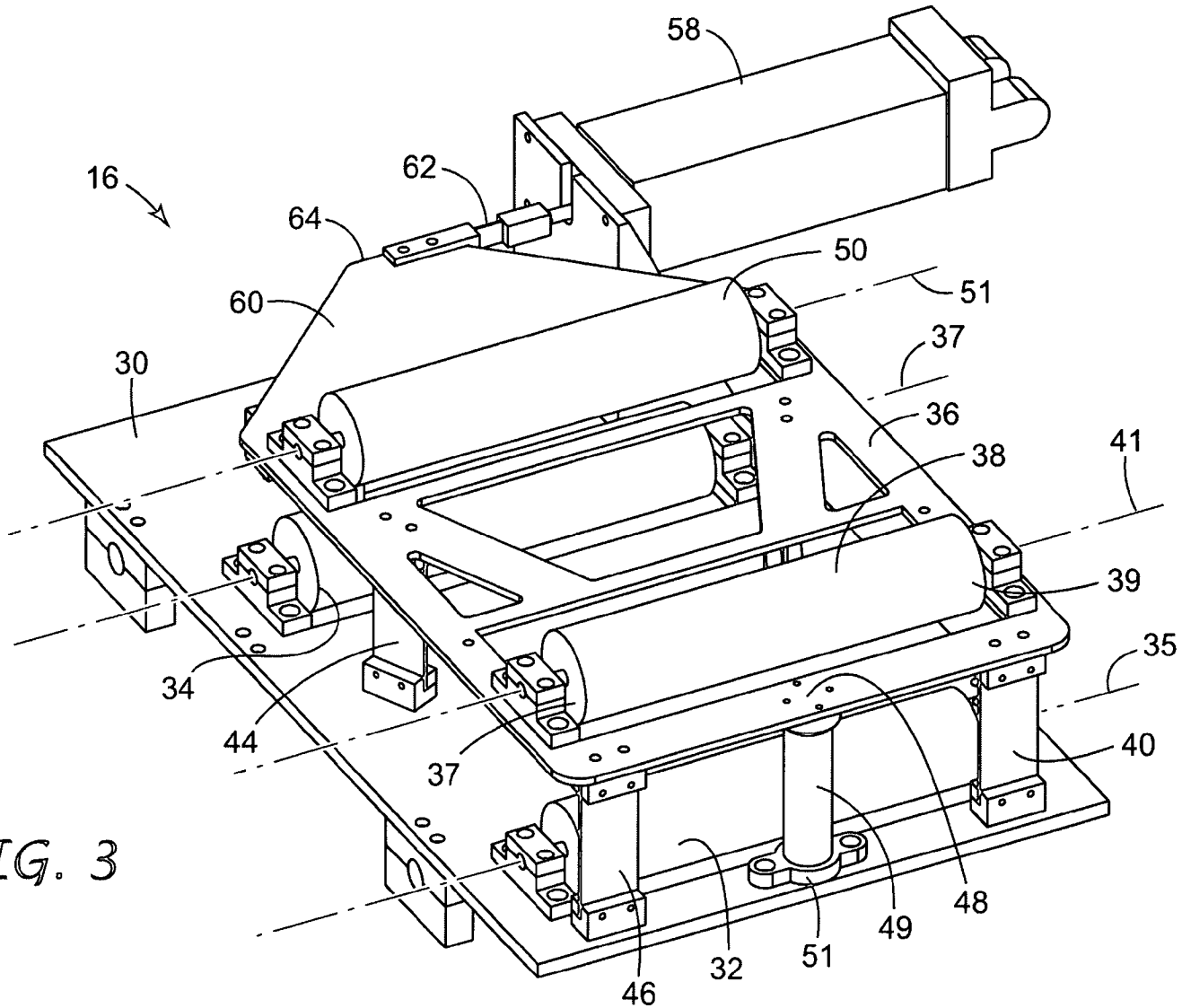
FIG. 3 is an additional perspective view of the precision web guide of the present invention.

The four flexure plates 40, 42, 44, 46 connect the frame 36 to the base 30 such that the frame 36 rotates about a point 48 proximate the first frame roller 38. Referring to FIGS. 2 and 3, an optional pivot pin 49 is disposed between the frame 36 and the base 30 where the pivot pin 49 is fixed to the frame 36 but rotatable with respect to the base 30. The pivot pin 49 is disposed within a bracket 51 attached to the base 30 to retain the pivot pin 49 in the selected position while allowing the pivot pin 49 to rotate therein.

Referring to FIGS. 2-5, the first and second flexure plates 40, 46, respectively, attach the frame 36 to the base 30 proximate ends 39 of the first frame roller 38. The first and second flexure plates 40, 46 are positioned such that the lengths of the flexure plates 40, 46 are substantially parallel to an axis of the first frame roller 38.

The third and fourth flexure plates 42, 44 connect the frame 36 to the base 30 between the first frame roller 38 and a second frame roller 50. The third and fourth flexure plates 42, 44, respectively are positioned at angles which are mirror images of each other as referenced from a plane perpendicularly intersecting a midpoint of the first frame roller 38. While the first and second flexure plates 40, 46, respectively, allow the frame 36 to move forward and backward relative to the path of the moving web 12; the third and fourth flexure plates 42, 44, respectively, allow the frame 36 to twist or rotate relative to the path of the moving web 12. The four flexure plates 40, 42, 44, 46 working in cooperation allow the frame 36 to pivot about the point 48 proximate the first frame roller 38. An exemplary pivot point 48 is about at the midpoint of an entrance tangent line of the moving web 12 with the first frame roller 38. In the context of this disclosure, what is meant by the entrance tangent line is the line defined by the first contact of the moving web with a roller.

After passing over the first frame roller 38, the moving web 12 passes over the second frame roller 50. The first and second frame rollers 38, 50, respectively, are also equipped with laterally loaded or precision bearings to minimize the amount of lateral backlash within the first and second frame rollers 38, 50. An exemplary laterally loaded bearing can be purchased along with an Ultralight Aluminum Idler manufactured by Webex, Inc. of Neenah, Wis.

One skilled in the art will recognize that one large roller may be substituted for the first and second frame rollers 38, 50, respectively. Additionally, one skilled in the art will recognize that the moving web 12 may pass over more than two rollers within the frame 36 while precisely controlling the transverse location of the moving web 12.

An axis 151 of the second frame roller 50 is approximately parallel to an axis 41 of the first frame roller 38. A distance from the first frame roller 38 to the second frame roller 50 defines a guide span 53 as best illustrated in FIG. 1. The guide span 53 is relatively long as compared to the width of the moving web 12.

One skilled in the art will recognize that a longer guide span reduces the amount of movement required by the flexure plates 40, 42, 44, 46 to produce a desired transverse position correction. The ability to control the transverse position of the moving web 12 with a minimal amount of movement allows for a more accurate web guide control because twist angles in an entrance span 55 and an exit span 57 are minimized.

Additionally, minimizing the amount of movement while accurately controlling a transverse position of the moving web 12 allows use of the flexure plates 40, 42, 44, 46 that have no mechanical backlash, but also have a limited range of motion. If significant motion were required, the movement may exceed the flexibility of the flexure plates 40, 42, 44, 46, thereby precluding the use of flexure plates in the present invention.

After passing over the last frame roller 50, the moving web 12 passes over the second base roller 34. In an exemplary embodiment, the path of the moving web 12 in the entrance and exit spans 55, 57, respectively is substantially perpendicular to a plane of rotation of the frame 36. Applying the principles taught herein, one skilled in the art will appreciate that other web paths are within the scope of the invention, including but not limited to, the first base roller 32 being disposed above the first frame roller 38 and also at an angle not substantially perpendicular to the first frame roller 38. Similarly, the second base roller 34 may be disposed in a position such that the path of the moving web 12 is not substantially perpendicular to the plane of rotation of the frame 36.

Referring to FIG. 1, a second control system 52 controls the precision web guide 16. The second control system 52 is preferably a closed loop feed back system. However, a feed forward system, H infinity system, model based system, embedded model based system or any other control system which will effectively control the transverse position of the moving web 12 is also within the scope of the invention.

The second control system 52 includes a second web position sensor 54 that detects a position of the edge of the moving web 12. One skilled in the art will recognize that other position detecting sensors besides edge position sensors are within the scope of the invention. The second positioning sensor 54 preferably includes a fast, high-resolution means of sensing a transverse position of the moving web 12 at an edge of the moving web 12 such as, at a minimum, a fifty-hertz sensor with at least twelve-micron resolution. A preferred second sensor 54 is a high speed, high precision digital micrometer Model No. LS-7030M manufactured by Keyence Corporation of America of Woodcliff Lake, N.J.

The second positioning sensor 54 preferable detects the transverse position of the moving web 12 at about or proximately below an exit tangent line 60 of the moving web 12 exiting the second frame roller 50. In the context of this disclosure, what is meant by the exit tangent line is the line defined by the last contact of the moving web with a roller. By sensing the transverse position at about or proximately below the exit tangent line 60 of the second frame roller 50, a transportation lag is minimized. What is meant by transportation lag is the transportation time from the last shifting roller, in this case the second frame roller 50, to the second positioning sensor 54.

However, the transverse position of the moving web 12 can be measured at numerous other locations including lower on the exit span or at about an exit tangent line of the moving web 12 exiting the second base roller 34. At these alternative transverse position sensing locations, the transportation lag will need to be accounted for in the control system.

The detected transverse position of the moving web 12 by the second web position sensor 54 is transmitted to a second controller 56. The second controller 56 compares the transverse position of the moving web 12 to a desired position or setpoint and calculates an error of the detected position from the desired position. The second controller 56 is typically a programmable logic controller using a proportional-integral (PI) controller with an update rate of at least about one millisecond. An exemplary controller is a TwinCAT PLC manufactured by Beckhoff Industrie Elektronik of Verl, Germany.

The second controller 56 communicates the error to a second actuator 58. The second actuator 58 is mounted to the base 30 or another stationary structure. Referring to FIGS. 2-5, the second actuator 58 is coupled to an extension 60 of the frame 36 that extends beyond the second frame roller 50 with a flexible bracket 62. The flexible bracket 62 is preferred to provide a zero backlash coupling of the actuator 58 to the frame 36. Further, the flexible bracket 62 allows the actuator 58 traveling in a linear motion to be coupled to the frame 36 that is traveling in an arcuate motion.

The plurality of flexure plates 40, 42, 44, 46 are designed to allow the frame 36 to rotate in a plane about the point 48 proximate the first frame roller 38 at about a midpoint of the entrance tangent line. As the frame 36 pivots about the point 48, an end 64 opposite the pivot point 48 moves in an arc. The flexible bracket 62 provides flexibility to allow the linear actuator 58 to cooperate with the frame 36 moving in an arcuate path.

The second actuator 58 has zero-backlash allowing for precise movement without mechanical play. The second actuator 58 is capable of control frequencies in excess of five hertz. An exemplary actuator is Model No. SR31-0605-XFM-XX1-238-PF-19413 manufactured by EXLAR (www.exlar.com). One skilled in the art will recognize that a direct linear or rotary motor may be used to practice the invention in place of the zero-backlash actuator.

Figure 4:
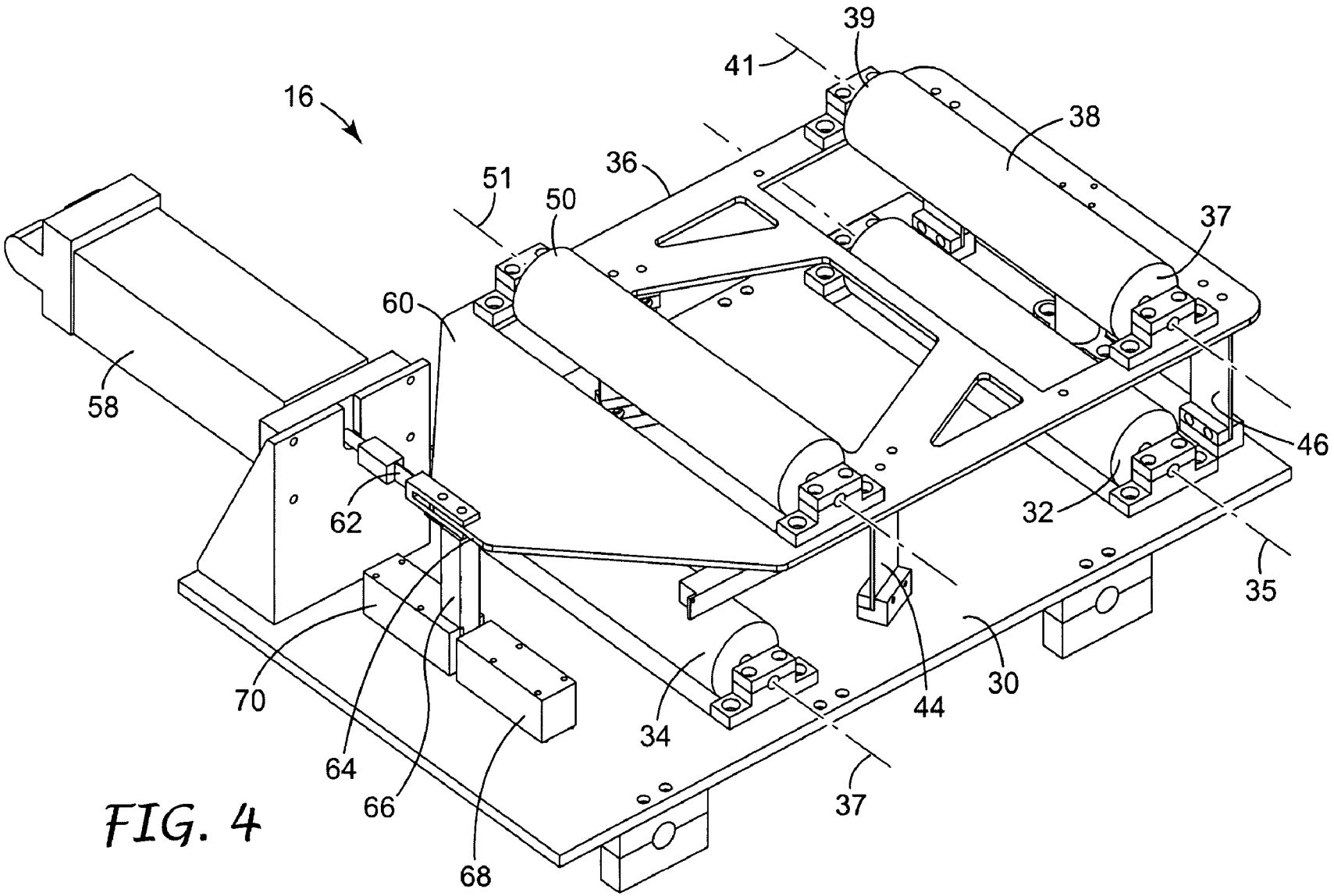
FIG. 4 is an additional perspective view of the precision web guide of the present invention.
Figure 5:
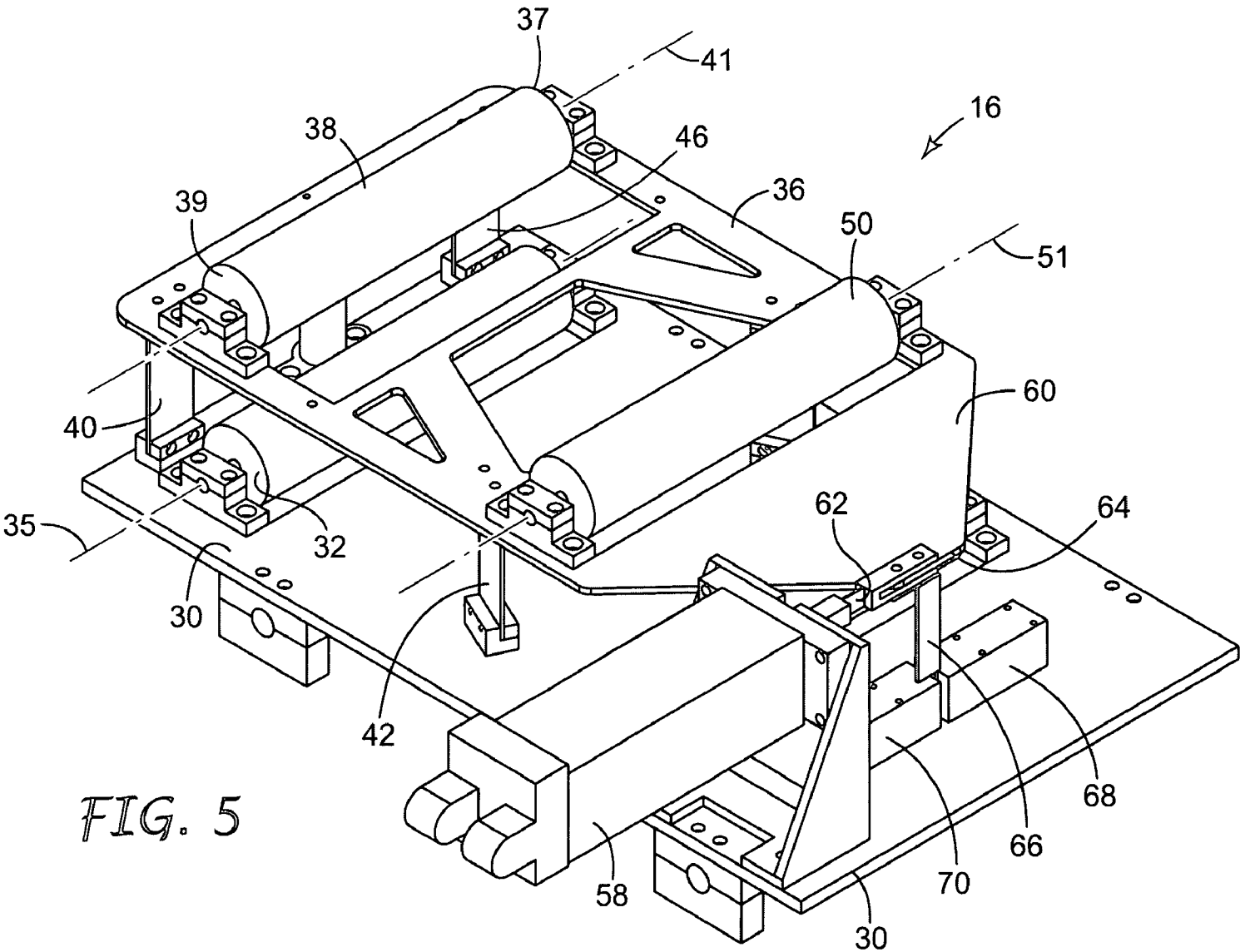
FIG. 5 is an additional perspective view of the precision web guide of the present invention.

The second actuator 58 does not require a significant amount of travel because the transverse position error is significantly reduced by the first web guide 14 and the first control system 22. Referring to FIGS. 4 and 5, a member 66 extending from the frame 36 towards the base 30 cooperates with first and second limit switches, 68, 70, respectively. If the member 66 contacts either of the limit switches 68, 70, the moving web 12 is stopped so that the web 12 can be manually realigned within the assembly 10.

The frame 36 is designed to have excess material removed to decrease the mass of the frame 36 while maintaining the required stiffness. Removing the excess material results in the frame 36 having a high natural frequency. Further, the decrease in mass of the frame 36 allows for a high system gain on the precision guide 16. The precision guide 16 of the present invention has a gain of greater than about thirty-three inverse seconds and a crossover frequency of greater than about five hertz.

Although the present invention has been described with reference to preferred embodiments, one having ordinary skill in the art will recognize that changes may be made in form and detail without departing from the spirit and scope of the invention.

What is claimed is:

1. A method of controlling a moving web in relation to a selected transverse position, the method comprising:

positioning a first positioning guide proximate a second positioning guide;

passing the web through the first positioning guide to reduce angular and transverse position errors;

passing the web through the second positioning guide wherein the second positioning guide positions the moving web independently of the first positioning guide with a mechanism having zero-backlash;

sensing a transverse location of the moving web at the second positioning guide with a sensor;

transmitting the transverse location of the web at the second positioning guide to a controller; and manipulating a zero-backlash actuator with the controller wherein the zero-backlash actuator is coupled to the second positioning guide such that the transverse position of the web is controllable to within a preselected dimension of the selected transverse position.

2. The method of claim 1 wherein the preselected dimension of the selected transverse position is less than about 0.004 inches.

3. The method of claim 1 wherein the preselected dimension of the selected transverse position is between about 0.0001 inches and 0.004 inches.

4. The method of claim 1 wherein the preselected dimension of the selected transverse position is less than about 0.0001 inches.

5. The method of claim 1 wherein an exit span of the first positioning guide is less than about one-half a web width.

6. The method of claim 1 wherein the mechanism for moving the web having zero-backlash comprises a plurality of flexure plates.

7. The method of claim 6 wherein the method of adjusting the web with the second positioning guide comprises:

fixing a base in a desired position;

disposing a first base roller and a second base roller within the base wherein an axis of the first base roller and an axis of the second base roller are approximately parallel;

disposing at least one frame roller within a frame;

coupling the frame to the base with the plurality of flexure plates wherein the plurality of flexure plates are positioned such that the frame moves relative to the base at about a midpoint of the entrance tangent line of the web with the first frame roller;

disposing the web from the first base roller to the first frame roller in the frame;

disposing the web from the last frame roller to the second base roller;

sensing the transverse location of the web;

computing an error of the transverse location of the web relative to a set point;

relaxing the error to the zero-backlash actuator; and manipulating the actuator coupled to the frame such that the frame rotates at about the midpoint of an entrance tangent line of the web with the first frame roller such that the position of the web at about an exit tangent line on the last frame roller changes so as to reduce the error of the transverse location of the moving web.

8. The method of claim 7 wherein the transverse location of the web is sensed at about at the exit tangent line of the moving web from the last frame roller.

9. The method of claim 7 and further comprising disposing first and second frame rollers within the frame wherein an axis of the first frame roller and an axis of the second frame roller are approximately parallel.

10. The method of claim 7 and further comprising coupling the actuator to the frame with a flexible plate.

11. The method of claim 1 wherein the sensor comprises at least a fifty hertz sensor with less than about twelve microns of resolution.

12. The method of claim 1 wherein the controller comprises a proportional-integral controller.

13. The method of claim 1 wherein the controller updates data from the sensor at a rate of at least about one hundred hertz.

14. The method of claim 1 wherein the zero-backlash actuator is capable of frequencies of greater than five hertz.

15. The method of claim 1 and further comprising controlling the first positioning guide with a feedback control system independent of the control system for the second positioning guide.

16. An assembly for controlling a transverse position of a moving web comprising:

a first positioning guide having a first entrance span and a first exit span wherein the first positioning guide manipulates a transverse position of the moving web;

a first loop control system cooperating with the first positioning guide wherein the first closed loop controller manipulates the first positioning guide to control the transverse position of the moving web;

a second positioning guide having a second entrance span and a second exit span wherein the second exit span is less than about one half a width of the web; and a second closed loop control system cooperating with the second positioning guide wherein the second closed loop controller manipulates the second positioning guide to control the position of the moving web to within less than 0.004 inches of the setpoint;

wherein the second positioning guide comprises:

a base fixed in a selected position wherein the base comprises a first base roller and a second base roller wherein an axis of the first base roller is approximately parallel to an axis of the second base roller;

a frame comprising at least one roller; and a plurality of flexure plates coupling the frame to the base wherein the plurality of flexure plates are positioned such that the frame moves relative to the base at about a midpoint of an entrance tangent line of the web with the first frame roller.

17. The assembly of claim 16 wherein a path of the web at the second entrance span and the second exit span are substantially perpendicular to a plane of rotation of the frame.

18. The assembly of claim 16 wherein the frame further comprises a first frame roller and a second frame roller wherein an axis of the first frame roller is approximately parallel to an axis of the second frame roller.

19. The assembly of claim 16 and wherein the second closed loop control system comprises:

a web position detecting instrument;

a controller wherein the controller receives a signal from the web position detecting instrument and compares the signal to a setpoint; and a positioning device attached to the frame and in communication with the controller wherein the positioning device provides a force to the frame which manipulates the position of the frame about the midpoint of an entrance tangent line of the web with the first frame roller.

20. The assembly of claim 19 wherein the web position detecting instrument detects the position of the web proximate an exit tangent line of the last frame roller.

21. The assembly of claim 19 wherein the positioning device comprises:

an actuator; and a flexible bracket wherein the flexible bracket couples the actuator to the frame.

22. The assembly of claim 21 wherein the actuator is capable of control frequencies of greater than about five hertz.

23. The assembly of claim 19 wherein the controller comprises an update rate of more than about one hundred hertz.

24. The assembly of claim 19 wherein the controller comprises a proportional-integral controller.

25. The assembly of claim 19 wherein the web position detecting instrument comprises at least a fifty hertz sensor with at least about twelve microns of resolution.

26. A precision web guide comprising:

a base comprising a first base roller and a second base roller wherein an axis of the first base roller is substantially parallel to an axis of the second base roller;

a frame comprising at least one frame roller;

a plurality of flexure plates attaching the frame to the base wherein the plurality of flexure plates are positioned in selected positions such that the frame rotates about a midpoint of an entrance tangent line of the web with a first frame roller;

a sensor wherein the sensor determines a transverse position of the web;

a controller communicating with the sensor wherein the control determines the error of the transverse position of the web from a selected transverse position;

a positioning device communicating with the controller wherein the positioning device is mounted to the base; and a flexible bracket directly coupling the frame and the zero backlash actuator wherein the zero backlash actuator provides a force to the frame through said flexible bracket such that the frame rotates about said midpoint of said entrance tangent line of the web with the first frame roller, to adjust the transverse position of the web.

27. The web guide of claim 26 wherein the frame further comprises:

a first frame roller; and a second frame roller wherein an axis of the first frame roller is substantially parallel to an axis of the second frame roller.

28. The web guide of claim 27 wherein the zero-backlash actuator is capable of control frequencies of greater than about five hertz.

29. The web guide of claim 26 further including a last frame roller down web of the at least one frame roller, and wherein a distance between the second base roller and the frame roller is less than about one-half a web width.

30. The web guide of claim 29 wherein the sensor determines the transverse position of the moving web proximate the exit tangent line of the last frame roller.

31. The web guide of claim 26 further including a last frame roller down web of the at least one frame roller, and wherein a distance between the second base roller and the last frame roller is less than about one-tenth a web width.

32. The web guide of claim 26 wherein a path at an entrance span and an exit span are substantially perpendicular to a plane of rotation the frame.

33. The web guide of claim 26 wherein the controller comprises an update rate of at least about one hundred hertz.

34. The web guide of claim 26 wherein the controller comprises a proportional-integral controller.

35. The web guide of claim 26 wherein the sensor comprises at least a fifty-hertz sensor with up to about twelve microns of resolution.

* * * * *

UNITED STATES PATENT AND TRADEMARK OFFICE

CERTIFICATE OF CORRECTION

PATENT NO. : 7,296,717 B2
APPLICATION NO. : 10/719557
DATED : November 20, 2007
INVENTOR(S) : Ronald P. Swanson It is certified that error appears in the above-identified patent and that said Letters Patent is hereby corrected as shown below:

Under item (56) References Cited
On Page 2, in Col. 2, under (Other Publications)
Line 5, delete "14-1to" and insert -- 14-1 to--, therefor.
Line 14, delete "Contrl" and insert -- Control --, therefor.

Col. 8
Line 47, in Claim 7, delete "relaxing" and insert -- relaying --, therefor.

Col. 9
Line 15, in Claim 16 (First occurrence), after "first" insert -- closed --.

Col. 10
Line 59, in Claim 32, after "rotation" insert -- of --.

Signed and Sealed this

Fifteenth Day of April, 2008

JON W. DUDAS
*Director of the United States Patent and Trademark Office*